US006817339B2

(12) United States Patent
Hirakata et al.

(10) Patent No.: US 6,817,339 B2
(45) Date of Patent: Nov. 16, 2004

(54) ENGINE CONTROL DEVICE

(75) Inventors: Yoshiaki Hirakata, Saitama (JP); Osamu Nishioka, Saitama (JP); Hideo Nihei, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 27 days.

(21) Appl. No.: 10/254,682

(22) Filed: Sep. 26, 2002

(65) Prior Publication Data

US 2003/0075148 A1 Apr. 24, 2003

(30) Foreign Application Priority Data

Sep. 27, 2001 (JP) ..... 2001-297608

(51) Int. Cl.[7] ..... F02D 9/00; F02M 51/00
(52) U.S. Cl. ..... 123/399; 123/400; 123/478
(58) Field of Search ..... 123/399, 361, 123/400, 478; 701/104, 110

(56) References Cited

U.S. PATENT DOCUMENTS 5,377,562 A * 1/1995 Kitagawa et al. ..... 477/110
6,199,540 B1 * 3/2001 Katashiba et al. ..... 123/478

FOREIGN PATENT DOCUMENTS

| | | | |
|---|---|---|---|
| JP | 56-107926 | 8/1981 | |
| JP | 61291729 | * 12/1985 | ..... F02B/37/04 |
| JP | 11-343901 | 12/1999 | |

* cited by examiner

*Primary Examiner*—Hai Huynh
(74) *Attorney, Agent, or Firm*—Birch, Stewart, Kolasch & Birch, LLP

(57) ABSTRACT

A totally closed value of the throttle valve of an engine having a fast idle function will be rendered capable of being correctly detected. The opening indicated value IACV to be supplied to the motor during a fast idle operation is a value obtained by adding the water temperature correction value and the atmospheric pressure correction value to the totally closed reference value. A value obtained by subtracting the water temperature correction value and the atmospheric pressure correction value from the actual opening to be detected by the throttle sensor is set to the totally closed value. When the value obtained by subtracting the water temperature correction value and the atmospheric pressure correction value from the actual opening goes out of the dead zone, the totally closed value is replaced with the value obtained by subtracting both correction values from the actual opening.

18 Claims, 10 Drawing Sheets

ENGINE CONTROL DEVICE

CROSS-REFERENCE TO RELATED APPLICATIONS

The present application claims priority under 35 USC 119 to Japanese Patent Application No. 2001-297608 filed on Sep. 27, 2001 the entire contents thereof is hereby incorporated by reference.

BACKGROUND OF THE INVENTION

1. Field of the Invention

The present invention relates to an engine control device. More particularly, to an engine control device for detecting a totally closed throttle valve and determining an amount of fuel supply on the basis of an opening of the throttle valve with reference to the detection signal.

2. Description of Background Art

On determining an amount of fuel supply of an internal combustion engine, there is known a control device (Japanese Published Unexamined Application No. 11-343901) in which an increase correction value of the amount of fuel supply is different between when a throttle opening is increased from a totally-closed position of a throttle valve and when the throttle opening is increased from any other position than the totally-closed position.

On the other hand, there is known an engine having a fast idle mechanism in which during warming up, a minimum opening of the throttle valve is mechanically made large to increase the idle speed. In such an engine, the actual opening of the throttle valve is different between during a fast idle operation and during a normal idle operation after warming up. Thus, there has been proposed a throttle valve totally closed detection device (Japanese Published Unexamined Application No. 56-107926) capable of detecting, even though a difference in opening during idling as described above, the minimum opening (totally closed) at that time.

In this device, there is provided means for storing the minimum value for an opening detection signal of the throttle valve, and when an error or a new value of the opening detection signal within a range of a predetermined dead zone falls short of a stored value, the above-described minimum value is replaced with the new value of the opening detection signal. According to this totally closed detection device capable of renewing the totally closed position of the throttle valve, the totally closed position can be detected irrespective of operation during fast idling or during normal idling.

In the opening of the throttle valve indicating the totally closed position, there is provided a dead zone, and when the throttle valve is opened with this dead zone exceeded, it is judged that the driver has performed an operation for acceleration. In an engine having the fast idle mechanism, there is set a dead zone which has been enlarged to a large opening corresponding to the fast idle. In the case where the dead zone has been enlarged to the fast idle region as described above, the throttle opening cannot be detected within this range of the dead zone, and therefore, it cannot be judged whether the throttle valve is opened by the driver or the throttle valve is opened by a fast idle mechanism.

SUMMARY AND OBJECTS OF THE INVENTION

It is an object of the present invention to solve the above-described problems, and to provide, in an engine having the fast idle mechanism, an engine control device capable of accurately judging a fully-closed state of the throttle valve.

In order to achieve the above-described object, according to a first feature of the present invention, there is provided an engine control device having a manual opening and closing means and an automatic opening and closing means of a throttle valve, in which a throttle opening indicated value for the automatic opening and closing means is a value obtained by adding, to a totally closed reference value, a water temperature correction value, that is a function of engine cooling water temperature, and an atmospheric pressure correction value, that is a function of the atmospheric pressure. The engine control device has a throttle opening detection means for detecting the throttle opening. Wherein a value obtained by subtracting the water temperature correction value and the atmospheric pressure correction value from an actual opening to be detected by the throttle opening detection means is set to a totally closed value of the throttle opening.

According to the first feature, even when the throttle valve is operated by the automatic opening and closing means in the control of the engine, the totally closed value is judged by a value obtained by subtracting the water temperature correction value and the atmospheric pressure correction value from the actual opening. Therefore, even when the throttle valve is operated by the automatic opening and closing means, the dead zone concerning the totally closed value can be maintained small.

Also, according to a second feature of the present invention, there is provided an engine control device wherein when a dead zone concerning the totally closed value is set and the value obtained by subtracting the water temperature correction value and the atmospheric pressure correction value from the actual opening goes out of the dead zone, there is provided a renewal means for replacing the totally closed value with the value obtained by subtracting the water temperature correction value and the atmospheric pressure correction value from the actual opening.

According to the second feature, when renewing the totally closed value in consideration of deterioration with time and the like, it is possible to perform a renewal by sensing a change in the total closeness due to a slight deterioration because the dead zone for renewal concerning the totally closed value can be used while it is made small.

Also, according to a third feature of the present invention, there is provided an engine control device wherein when the value obtained by subtracting the water temperature correction value and the atmospheric pressure correction value from the actual opening continues for a scheduled renewal time period to go out of the dead zone, the renewal means is constructed to renew the totally closed value. According to the third feature, it is possible to prevent the totally closed value from being renewed by detecting an instantaneous change in the totally closed state.

Further, according to a fourth feature of the present invention, there is provided an engine control device wherein fuel increase correction values are set which are different from each other between when the opening is increased from the totally closed position and when the opening is increased from any other position than the totally closed position. The present invention corrects the reference amount of fuel supply by using the fuel increase correction value. According to the fourth feature, the reference amount of fuel supply can be corrected on the basis of a correct totally closed value to be detected.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 2:
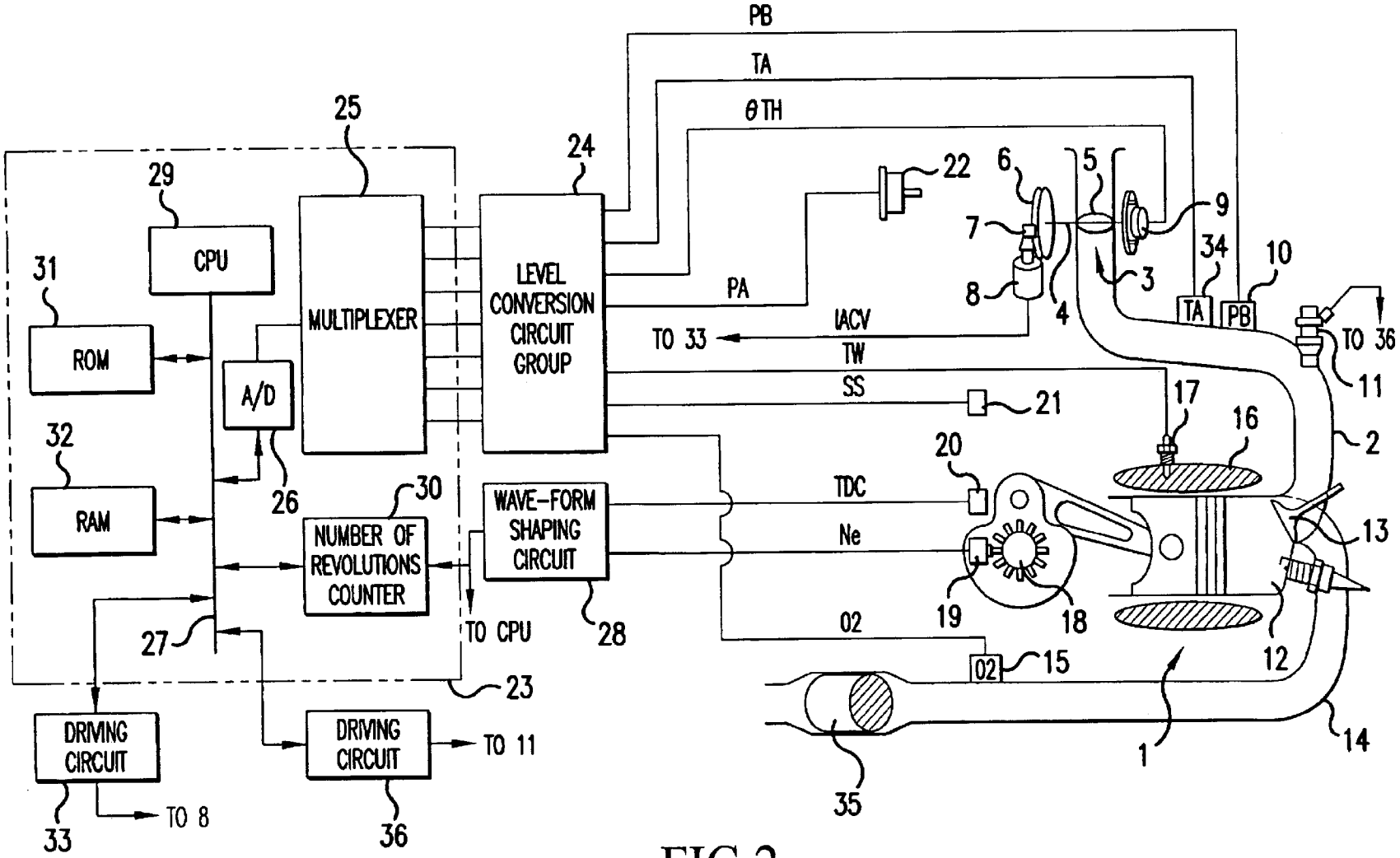
FIG. 2 is a system block diagram showing an engine equipped with a control device according to an embodiment of the present invention.

Hereinafter, with reference to the drawings, the description will be made of an embodiment of the present invention. FIG. 2 is a block diagram showing a system configuration of an engine control device according to an embodiment of the present invention. In FIG. 2, in an intake pipe 2 of the engine 1, there is provided a throttle valve 3 for controlling an amount of intake air. The throttle valve 3 has an axle 4 and a valve body 5 to be fixed to this axle 4. The valve body 5 is freely rotatable around the axle 4 within a range of a predetermined angle.

To one end of the axle 4, there is fixed a throttle drum 6, which is connected to an accelerator operation (accelerator grip in, for example, a motorcycle) of the engine 1 through a cable (not shown). Further, the throttle drum 6 engages with a stepping motor 8 through a cam 7 for opening and closing the drum. A rotation of the stepping motor 8 is converted into rocking by the cam 7. The rocking of the cam 7 rocks the throttle drum 6.

An oscillation angle of the throttle drum 6, that is, the opening (hereinafter, referred to as "throttle opening") of the throttle valve 3 is determined correspondingly to the operation of the accelerator operator as the manual opening and closing means, and the throttle opening θTH during idling is determined by a number of steps to be supplied to the stepping motor 8 as automatic opening and closing means, that is, an opening indicated value IACV of the throttle valve 3. The throttle opening θTH is detected by a throttle opening sensor 9 to be provided at the other end of the axle 4. The throttle opening sensor 9 can be constituted by a potentiometer.

Further, the intake pipe 2 is provided with an intake pipe pressure sensor 10 for detecting the intake pipe negative pressure PB, an intake air temperature sensor 34 for detecting intake air temperature TA and a fuel injection valve 11. In an intake port which is opened in a combustion chamber 12 of the engine 1, there is provided an intake valve 13. In the combustion chamber 12, an exhaust pipe 14 is also connected, and at the end portion of this exhaust pipe on the combustion chamber 12 side, there is formed an exhaust port, which is provided with an exhaust valve (either of them is not shown). In the exhaust pipe 14, an O2 sensor 15 for detecting oxygen concentration 02 in the exhaust gas and a muffler 35 are provided.

In a water cooling jacket 16 of the engine 1, there is provided a water temperature sensor 17 for detecting the temperature TW of cooling water representing the temperature of the engine 1. Around a crankshaft 18, a rotary sensor 19 for outputting a pulse signal for a predetermined crank angle (for example, 30°), and a TDC sensor 20 for detecting the top dead center (TDC) of the piston are provided. Further, the engine 1 is provided with a speed change detection sensor 21 for detecting the position of a speed change step of a transmission (not shown) to generate a position signal SS. In the vicinity of the engine 1, there is provided an atmospheric pressure sensor 22 for detecting the atmospheric pressure PA.

A detection signal by each of the above-described sensors is inputted into an electronic control unit (hereinafter, referred to as "ECU") 23. A detection signal θTH, PB, 02, TW, SS, PA, TA by each sensor 9, 10, 15, 17, 21, 22, 34 is supplied to a level conversion circuit group 24, and after converted into a voltage signal within a predetermined range, is inputted into a multiplexer 25 within ECU 23. The multiplexer 25 supplies a detection signal by each of the above-described sensors 9, 10, 15, 17, 21, 22, 34 to an AD converter 26 successively every predetermined read timing. The AD converter 26 converts an analog signal to be supplied into a digital signal to supply it to an input-output bus 27.

Also, a detection signal from the rotary sensor 19 and the TDC sensor 20 is, after wave-form shaped in a wave-form shaping circuit 28, interrupt-inputted into CPU 29, and is inputted into a number of revolutions counter 30. The number of revolutions counter 30 supplies a signal representing the number of revolutions of the engine 1 into the input-output bus 27 on the basis of a detection signal by the rotary sensor 19.

ROM 31, RAM 32, a driving circuit 33 for the stepping motor 8 and a driving circuit 36 for a fuel injection valve 11 are connected to the input-output bus 27. The fuel injection valve 11 is driven in accordance with a duty ratio that is determined on the basis of a fuel injection control signal to be supplied from CPU 29, that is, injection time TOUT, and fuel in an amount corresponding to this duty ratio is injected towards the intake port.

Figure 3:
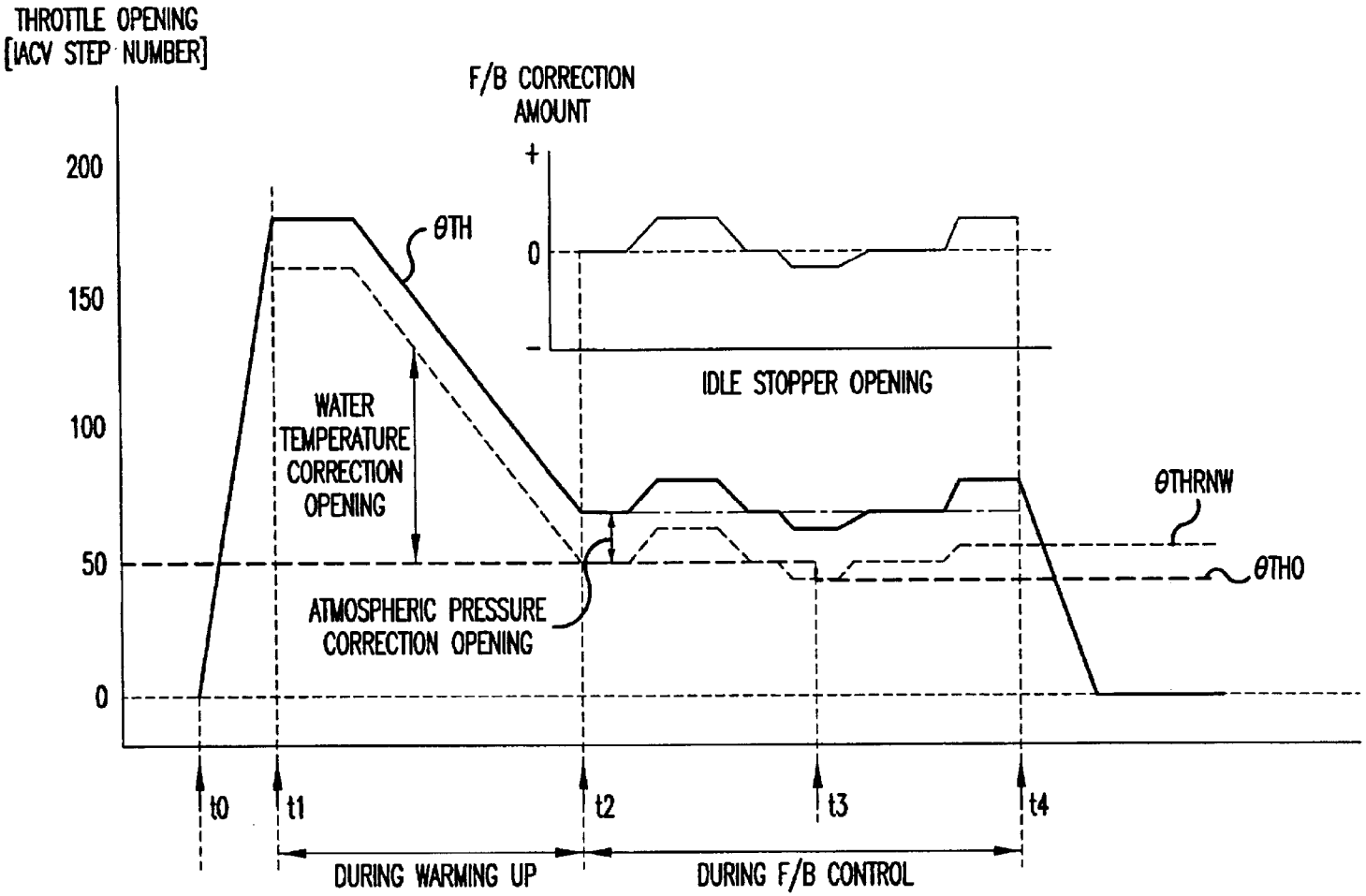
FIG. 3 is a view showing a change in throttle opening during idling.

FIG. 3 is a view indicating a change in a throttle opening (including an actual opening θTH and values obtained by subtracting various correction values from the actual opening θTH) during idling of the engine 1. In FIG. 3, the actual opening θTH is determined by an opening indicated value IACV to be supplied to the stepping motor 8. The actual opening θTH is, in the fuel injection control, used for, for example, control during acceleration and idle judgment.

Before engine starting, the actual opening θTH is "0". When an ignition switch is turned ON at timing t0, a value obtained by adding the water temperature correction value ITW and the atmospheric pressure correction value KIPA to an idle stopper opening (initial set value) θTHSP is set to the opening indicated value IACV to start the engine 1. More specifically, during the engine starting, and during warming up thereafter, fast idle in which the stepping motor 8 is energized to make the throttle opening larger than during idling after warming up is performed. As a correction value for correcting the throttle opening in a direction to increase, the water temperature correction value ITW is used. In this respect, the above-described idle stopper opening θTHSP is set in a memory (for example, EEPROM) as an initial value.

The throttle valve 3 is opened and closed during the fast idle or by the stepping motor 8 under feedback control. Therefore, when a totally closed position, that is a reference value for the throttle opening to follow a change in the throttle opening, that is, a throttle totally closed reference value (hereinafter, simply referred to as "totally closed reference value") θTH0 is changed, the control becomes complicated.

Also, the totally closed reference value θTH0 is provided with a dead zone, and when this dead zone is caused to follow a change in the opening by the stepping motor 8 and is enlarged, it cannot be judged whether the opening has been changed by the fast idle mechanism or under the control of the driver. Further, the totally closed value renewal control in which the totally closed reference value θTH0 is caused to be changed in consideration of the deterioration with time of the throttle valve 3 and the like is preferably made, but it is difficult to perform a renewal in accordance with the actual opening θTH which changes under the feedback control.

Thus, in the present embodiment, the throttle totally closed reference value θTH0 is provided with a narrow dead zone. And when a value obtained by subtracting the atmospheric pressure correction value KIPA from the actual opening θTH during the feedback control fluctuates more than the width of the dead zone (dead zone for renewing the totally closed opening) from a totally closed renewal target value θTHRNW, it has been determined that the totally closed reference value θTH0 would be renewed. In other words, in the renewal of the totally closed reference value θTH0, the actual opening θTH has been made not to be directly reflected.

During warming up immediately after the engine starting, namely, during a period of timing t1 to timing t2, the water temperature correction value ITW corresponding to the cooling water temperature TW of the engine 1 is added to the idle stopper opening θTHSP. Accordingly, during this warming up, the actual opening θTH becomes larger than in the period thereafter, and the so-called fast idle period is entered. During the warming up, the cooling water temperature TW of the engine 1 gradually rises, and since the water temperature correction value ITW becomes smaller as the cooling water temperature TW rises, the actual opening θTH also gradually becomes smaller.

When the warming up is completed, timing t2 to t4 becomes a feedback (F/B) control period. During the feedback control, the water temperature correction value ITW is almost zero, and the actual opening θTH becomes equal to a value obtained by adding the atmospheric pressure correction value KIPA and a feedback correction value IFB to the idle stopper opening θTHSP. The feedback correction value IFB is a value corresponding to a deviation of an actual number of revolutions Ne of the engine from the target value of the idle speed.

During this feedback control, when a value obtained by subtracting the atmospheric pressure correction value KIPA from the actual opening θTH, in other words, a value (hereinafter, referred to as "renewal reference value") θTHRNW obtained by adding the feedback correction value IFB to the idle stopper opening θTHSP goes out of a dead zone to be provided concerning a throttle totally closed renewal target value (hereinafter, referred to "totally closed renewal target value" simply) θTHTGT, the totally closed reference value θTH0 is renewed. The renewal of the totally closed reference value θTH0 will be further described later. In FIG. 3, at timing t3, the totally closed reference value θTH0 is renewed in a downward direction, that is, to a smaller value. At timing t4, the ignition switch is turned OFF, and the actual opening θTH becomes smaller toward "0".

Figure 4:
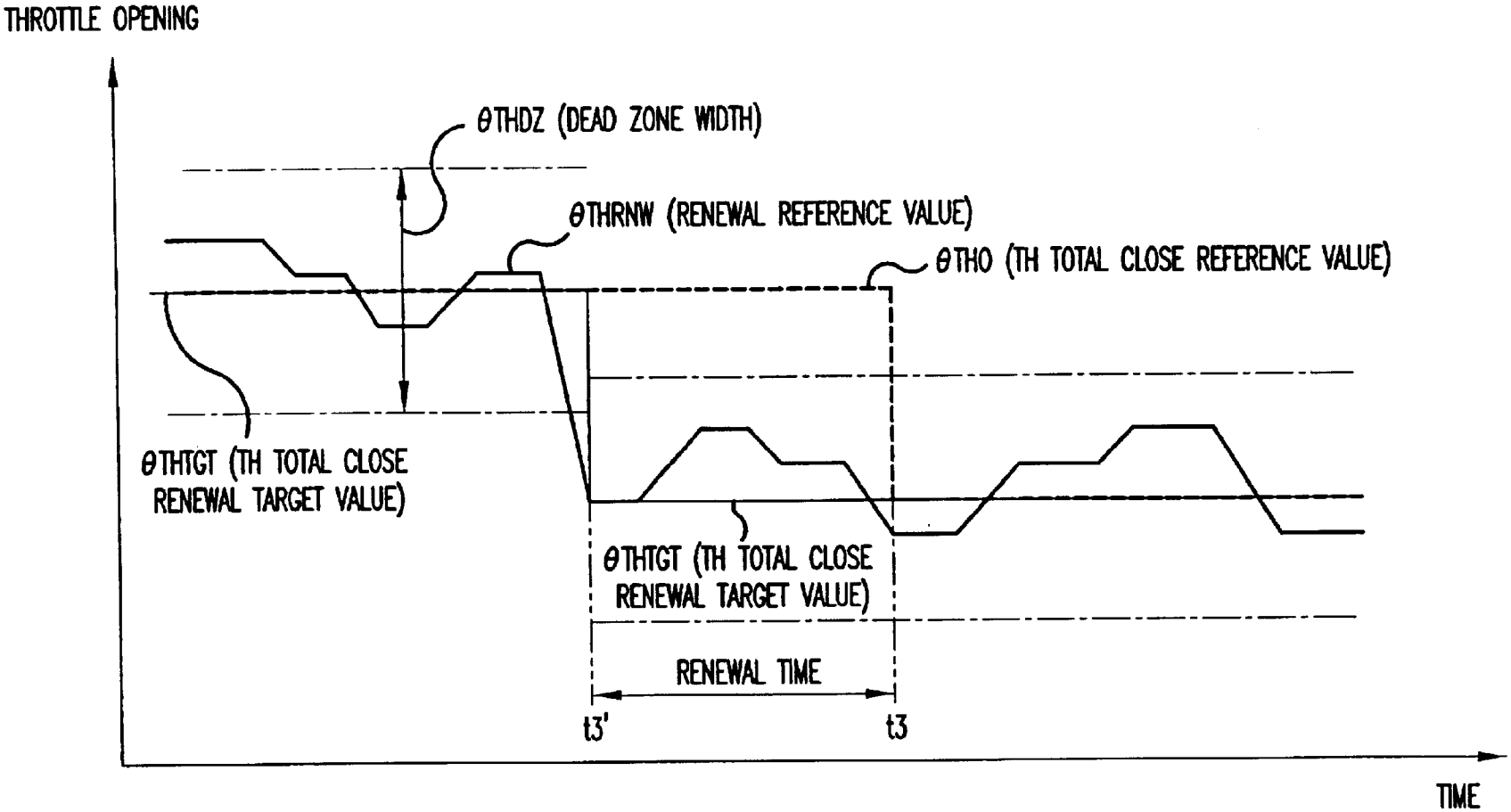
FIG. 4 is a view showing a principal part indicating a change in throttle opening during feedback control.

FIG. 4 is a view for a principal part indicating a change in the throttle opening during the feedback control. In FIG. 4, a totally closed renewal target value θTHTGT is provided, and this totally closed renewal target value θTHTGT is provided with a dead zone θTHDZ. As an initial value for the totally closed renewal target value θTHTGT, an initial value (which is determined by an initial value of the idle stopper opening) of the totally closed reference value θTH0 is set. When the renewal reference value θTHRNW goes out of the dead zone θTHDZ to be set concerning the totally closed renewal target value θTHTGT, the totally closed renewal target value θTHTGT is replaced with the renewal reference value θTHRNW (timing t3' of FIG. 3). When the totally closed renewal target value θTHTGT changes, the totally closed reference value θTH0 is also renewed along with this change. However, only when after the totally closed renewal target value θTHTGT is changed, and the renewal reference value θTHRNW has still been out of the dead zone θTHDZ of the original totally closed renewal target value θTHTGT even though the scheduled renewal time has elapsed, the totally closed reference value θTH0 will be actually renewed (timing t3 of FIG. 3).

Figure 5:
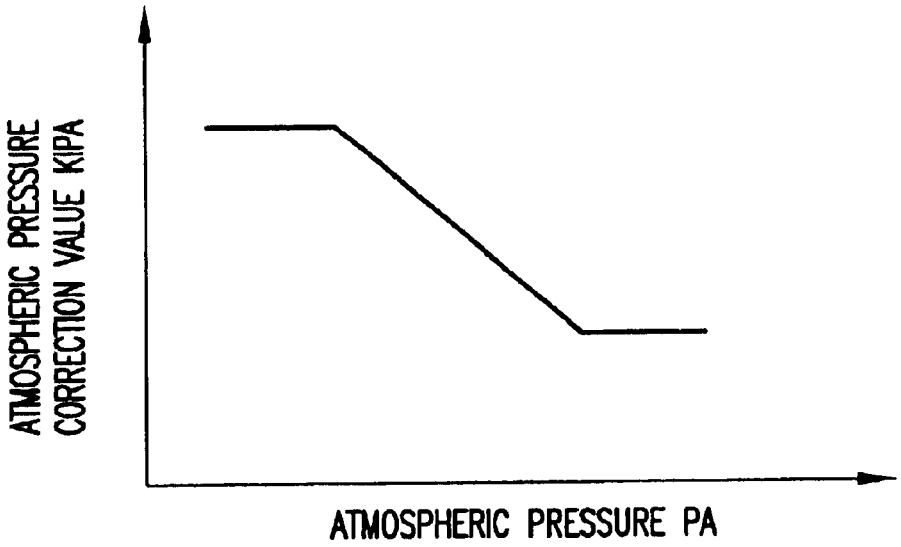
FIG. 5 is a view showing a water temperature correction value of the throttle opening indicated value.

FIG. 5 is a view showing an example of a table in which the relationship between the atmospheric pressure correction value KIPA and the atmospheric pressure PA has been set. In this table, the atmospheric pressure correction value KIPA is set so as to correct an amount of air that becomes insufficient owing to a change in the atmospheric pressure. On the basis of the atmospheric pressure PA, the atmospheric pressure correction value KIPA can be determined by referring to this table.

Figure 6:
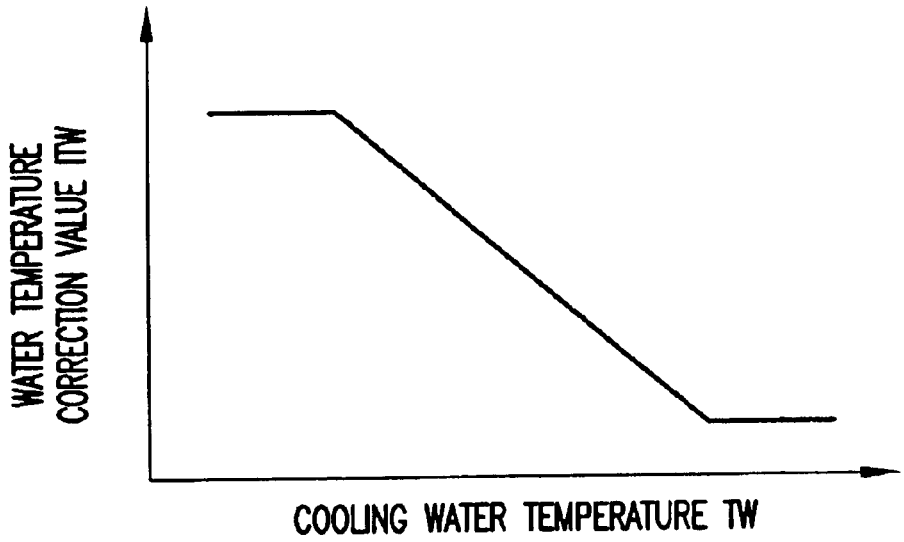
FIG. 6 is a view showing an atmospheric pressure correction value of the throttle opening indicated value.

FIG. 6 is a view showing an example of a table in which the relationship between the water temperature correction value ITW and the cooling water temperature TW of the engine 1 has been set. In this table, the water temperature correction value ITW is set in accordance with the cooling water temperature TW of the engine 1. On the basis of the cooling water temperature TW of the engine 1, the water temperature correction value ITW can be determined by referring to this table.

Figure 7:
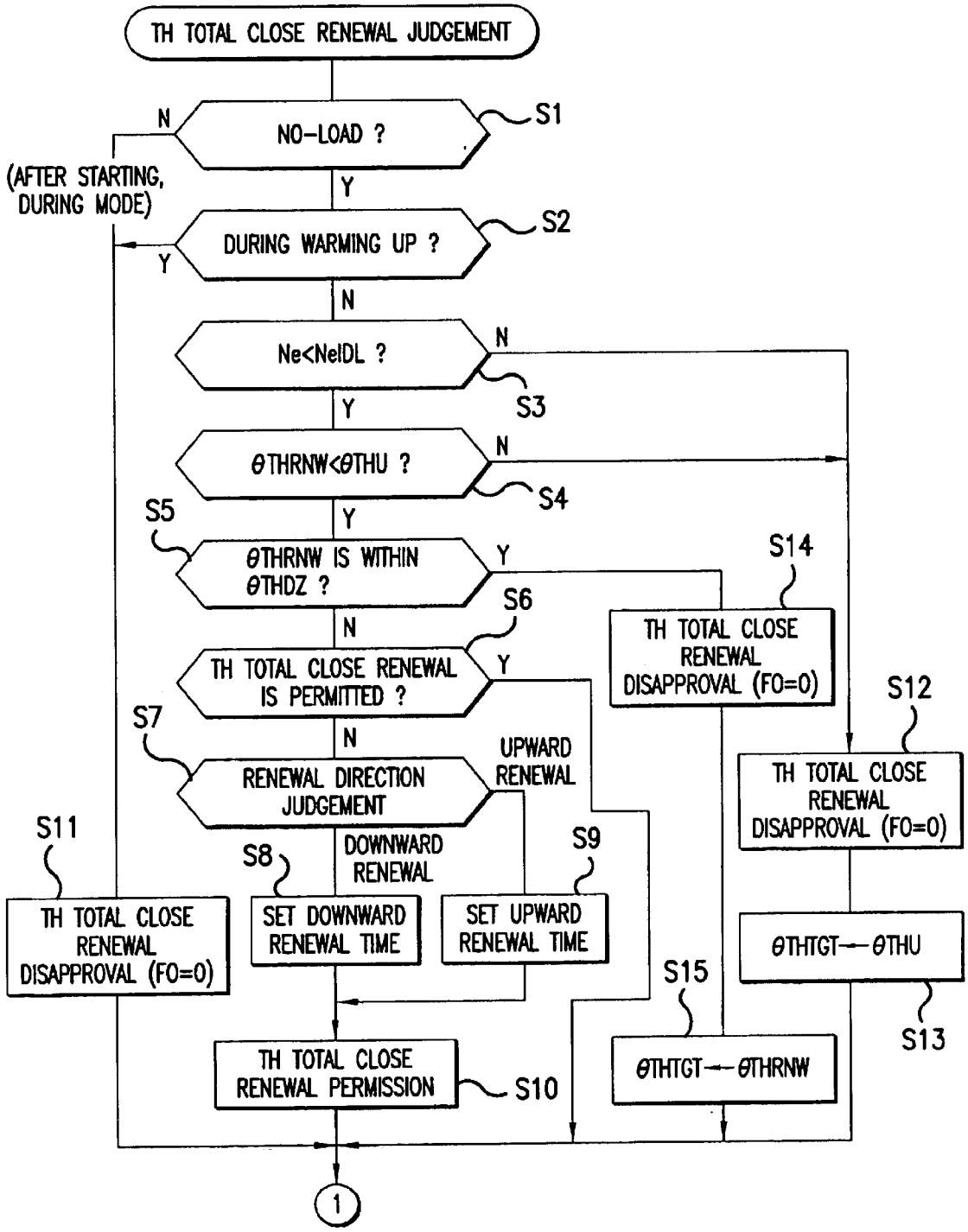
FIG. 7 is a flowchart (Part 1) showing throttle totally closed renewal control.
Figure 8:
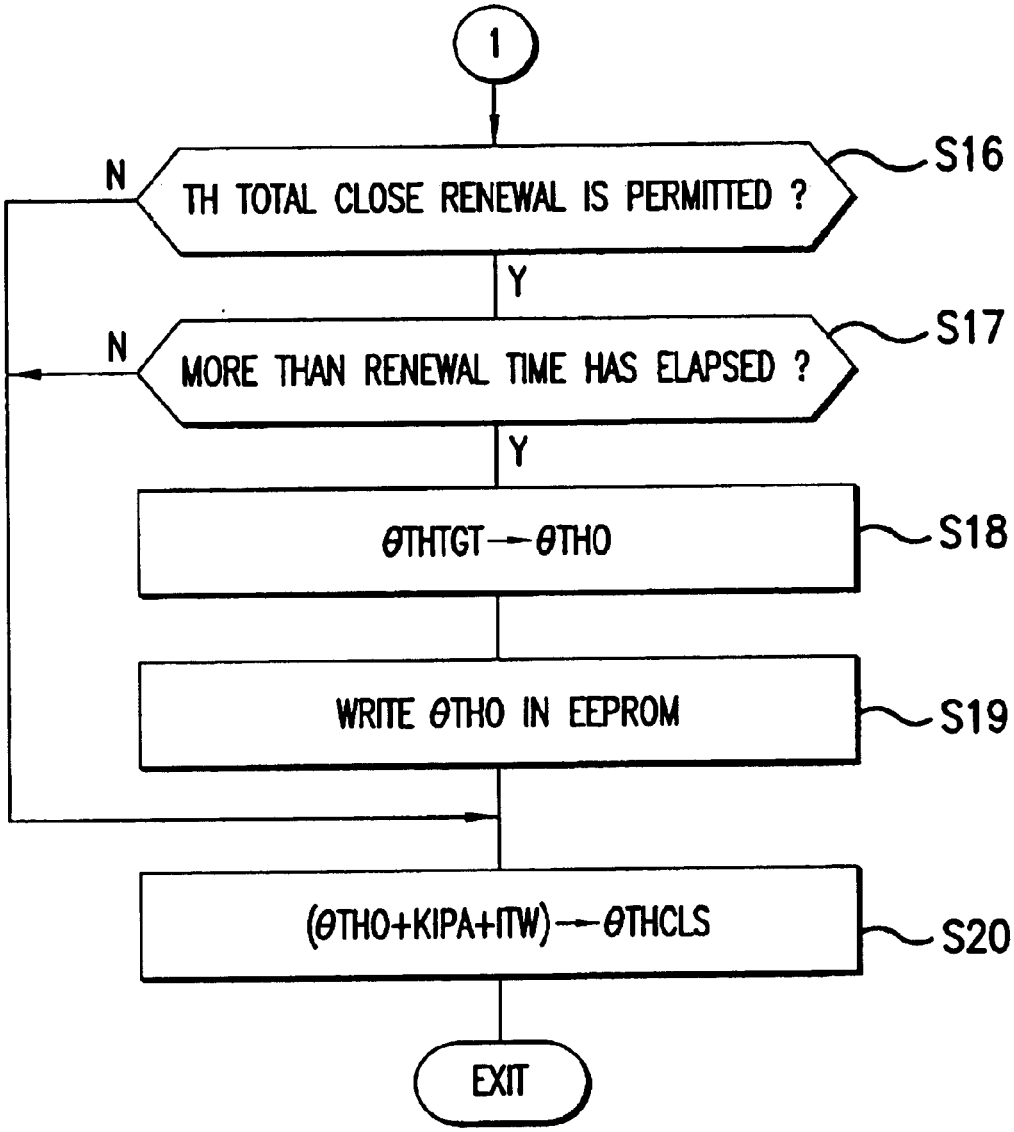
FIG. 8 is a flow chart (Part 2) showing throttle totally closed renewal control.

FIGS. 7 and 8 are flow charts showing the judgment of the throttle valve totally closed renewal. In FIG. 7, in a step S1, it is judged whether or not the engine 1 has no-load. This judgment is performed by whether or not the transmission is in a neutral position on the basis of an output signal SS from a speed change detection sensor 21. When the transmission is in a neutral position, that is, no-load is applied, the sequence will proceed to a step S2 to judge whether or not warming up is being performed. This judgment is performed whether or not the engine water temperature TW to be detected by a water temperature sensor 17 is lower than a reference temperature TWO for judging that the warming up is being performed. If the engine water temperature TW is higher than the reference temperature TWO and it is judged that the warming up has been completed, the sequence will proceed to a step S3. When not a no-load (NO in step S1) or when not during a warming up (YES in step S2), the sequence will proceed to a step S11 to clear (=0) a flag FO indicating permission of throttle totally closed renewal. That is, disapproval of the throttle totally closed renewal is stored.

In a step S3, it is judged whether or not the number of revolutions Ne of the engine to be detected on the basis of the output from a number of revolutions counter 30 is lower than an idle judgment number of revolutions NeIDL preset in a low rotation area. If the engine number of revolutions Ne is lower than an idle judgment number of revolutions NeIDL, the sequence will proceed to a step S4 to judge whether or not a value (θTH-KIPA) obtained by subtracting the atmospheric pressure correction value KIPA from the present throttle opening (actual opening) θTH, that is, the renewal reference value θTHRNW is lower than a throttle totally closed renewal upper limit opening θTHU to be preset.

If the step S4 is affirmative, the sequence will proceed to a step S5 to judge whether or not the renewal reference value θTHRNW is within a throttle totally closed renewal target range, that is, whether or not it is within a dead zone range θTHDZ of the throttle totally closed renewal target value θTHTGT.

If the number of revolutions Ne of the engine is not lower than the idle judgment number of revolutions NeIDL (NO in step S3), or if the renewal reference value θTHRNW is not lower than the throttle totally closed renewal upper limit opening θTHU (NO in step S4), the sequence will proceed to a step S12 to clear the flag FO indicating the permission of throttle totally closed renewal. Further, in a step S13, the throttle totally closed renewal target value θTHTGT will be replaced with the throttle totally closed renewal upper limit opening θTHU.

If the step S5 is affirmative, the sequence will proceed to a step S6 to distinguish on the basis of the flag F0 whether or not the throttle totally closed renewal is permitted. Since at first, the flag F0 has been cleared and the throttle totally closed renewal has been disapproved, the step S6 becomes negative, and the sequence will proceed to a step S7. In the step S7, it is judged whether the throttle totally closed renewal direction is downward (a direction to close the valve) or upward (a direction to open the valve). If in a downward renewal, the sequence will proceed to a step S8 to set a downward renewal time to a timer. Also, if the upward renewal, the sequence will proceed to a step S9 to set upward renewal time to the timer. The downward renewal time is for example, 0.3 second, and the upward renewal time is longer time the downward renewal time, for example three seconds. In a step S10, a flag F0 for indicating the throttle totally closed renewal permission will be set (=1). If the step S6 is affirmative, that is, when the flag F0 indicating the throttle totally closed renewal permission has been set, steps S7 to S10 will be skipped to proceed to a step S16 (FIG. 8).

If the renewal reference value θTHRNW is not within the dead zone θTHDZ of the throttle totally closed renewal target value θTHTGT, the step S5 becomes negative, and the sequence will proceed to a step S14 to clear the flag F0. Successively, in a step S15, the throttle totally closed renewal target value θTHTGT will be replaced with the renewal reference value θTHRNW.

In a step S16 of FIG. 8, it is judged whether the throttle totally closed renewal is permitted (F0=1) or not (F0=0), the sequence will proceed to a step S17 to judge whether or not the above-described downward or upward renewal time has elapsed.

When the renewal time has elapsed, the sequence will proceed to a step S18 to replace the throttle totally closed renewal target value θTHTGT with the totally closed reference value θTH0. In a step S19, the totally closed reference value θTH0 renewed will be written in a memory (EEPROM). In a step. S20, a value obtained by adding the atmospheric pressure correction value KIPA and the water temperature correction value ITW to the totally closed reference value will be stored as a throttle totally closed value θTHCLS.

When the flag F0 indicating the throttle totally closed renewal permission has not been set (NO in step S16), or when the renewal time has not elapsed (NO in step S17), the steps S18 and S19 will be skipped to proceed to a step S20.

As described above, the totally closed reference value θTH0 is renewed on the basis of a value (renewal reference value) obtained by eliminating the water temperature correction value ITW and the atmospheric pressure correction value KIPA, and fuel injection control is executed through the use of actual opening θTH of the throttle valve 3 including the water temperature correction value ITW and the atmospheric pressure correction value KIPA.

Figure 1:
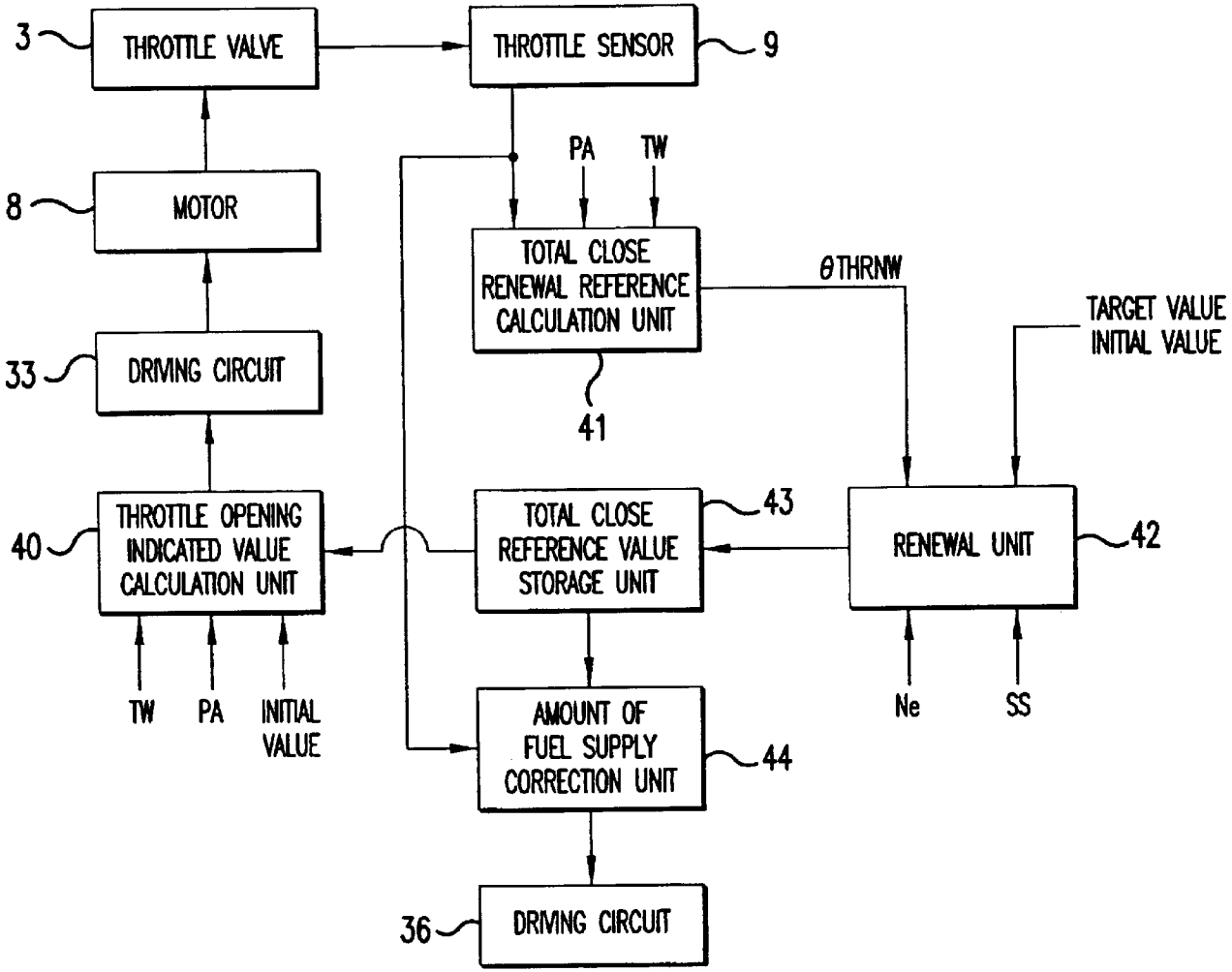
FIG. 1 is a block diagram showing the function of a principal part of a control device according to an embodiment of the present invention.

FIG. 1 is a block diagram showing the principal functions of the totally closed detection and renewal control. In FIG. 1, a throttle opening indicated value calculation unit 40 calculates a throttle opening indicated value on the basis of an idle stopper value (initial value) θTHSTP, atmospheric pressure PA and cooling water temperature TW to supply it to a driving circuit 33. The idle stopper value θTHSTP is renewed with the totally closed reference value θTH0. The driving circuit 33 drives the stepping motor 8 in response to the throttle valve 3. The throttle sensor 9 inputs the throttle opening θTH thus detected into a totally closed renewal reference value calculation unit 41.

The totally closed renewal reference value calculation unit 41 subtracts the cooling water temperature TW and the atmospheric pressure PA from the throttle opening θTH to determine the totally closed renewal reference value θTHRNW. A renewal unit 42 detects a deviation of the totally closed renewal reference value θTHRNW from the totally closed renewal target value θTHTGT, and if deviated more than a scheduled dead zone width, the totally closed reference value θTH0 will be renewed with the totally closed renewal target value θTHTGT. The initial value of the totally closed renewal target value θTHTGT is the idle stopper value θTHSTP, and thereafter, will be replaced with the totally closed reference value θTH0 that has been deviated more than the above-described dead zone width. The totally closed reference value θTH0 renewed will be stored in a totally closed reference value storage unit 43.

An amount of fuel supply correction unit 44 corrects a basic amount of fuel supply (injection time) on the basis of a parameter representing an engine state, and fuel injection time as an amount of fuel supply indicated value corrected is supplied to a driving circuit 36 for the fuel injection valve. In the amount of fuel supply correction unit 44, a totally closed value θTHCLS based on the totally closed reference value θTH0 is used to correct the basic amount of fuel supply.

Figure 9:
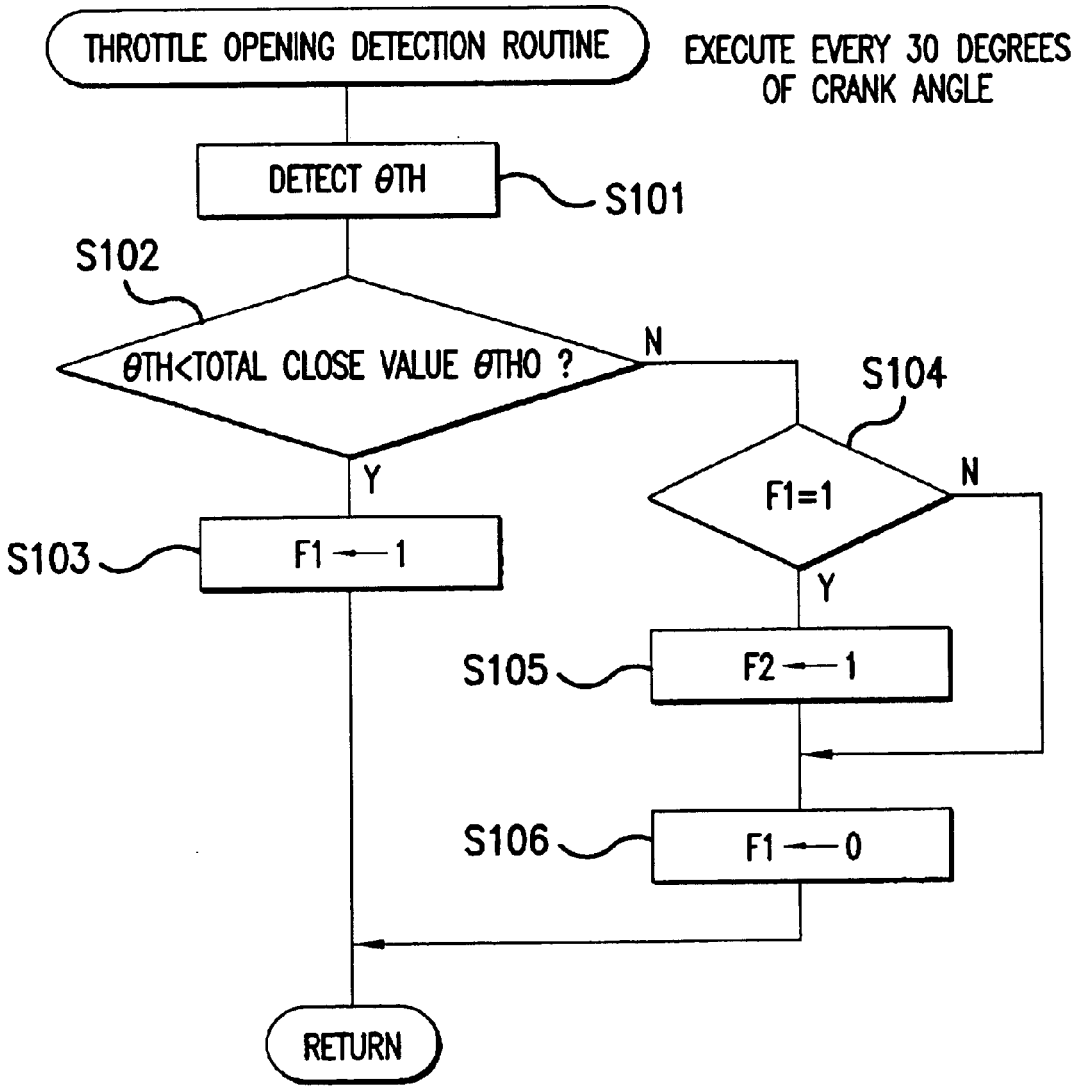
FIG. 9 is a flow chart showing a throttle opening detection routine.

Successively, the description of an example of fuel injection control in which the throttle opening θTH has been used will be described. FIG. 9 is a flow chart showing a subroutine for detecting the opening of the throttle valve. This processing is executed every scheduled time, for example, every 30° in crank angle on the basis of a detection signal from the rotary sensor 19. In a step S101, the throttle opening θTH will be detected. In a step S102, whether or not the throttle is totally closed is judged by whether or not the throttle opening θTH is equal to or less than the throttle totally closed value θTHCLS. If the step S102 is affirmative, the sequence will proceed to a step S103 to set a flag F1 indicating a totally closed state.

On the other hand, when the step S102 is negative, that is, when the throttle valve 3 is not in a totally closed state, the sequence will proceed to a step S104, and by whether or not the flag F1 has been set, it is judged whether or not it has been a totally closed state during the previous detection. When the step S104 is affirmative, that is, when it has been judged that the throttle opening is increased from the totally closed state, the sequence will proceed to a step S105 to set a flag F2 indicating an increase in throttle opening from the totally closed state. In a step S106, the flag F1 will be cleared. When the step S104 is negative, it is judged that the throttle opening θTH has changed from any other states than the totally closed, and the step S105 will be skipped to proceed to a step S106. In other words, in this case, the flag F2 will not be set.

Figure 10:
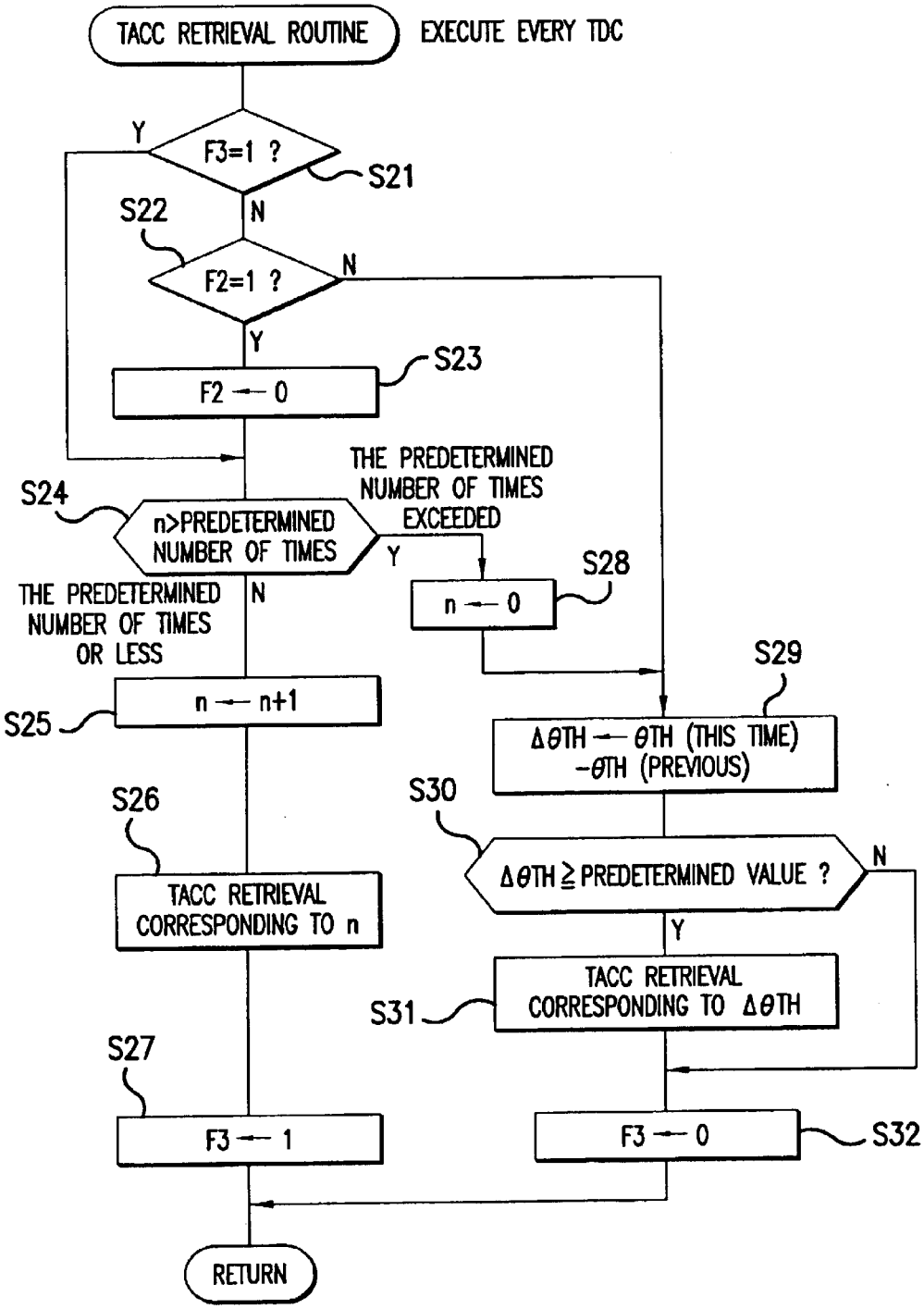
FIG. 10 is a flow chart showing an increase correction value retrieval routine of the amount of fuel supply.

FIG. 10 is a flow chart showing a subroutine for retrieving an increase correction value TACC for the fuel. This processing is executed every schedule time, for example, every TDC. In a step S21, it is first judged whether or not the flag F3 has been set. This flag F3 is a flag indicating whether or not an increase correction value TACC retrieval process when it is distinguished that the throttle valve 3 has been opened from the totally closed state, is being performed. When it is distinguished that the flag F3 has not been set, it is judged in a step S22 whether or not the flag F2 has been set.

Figure 11:
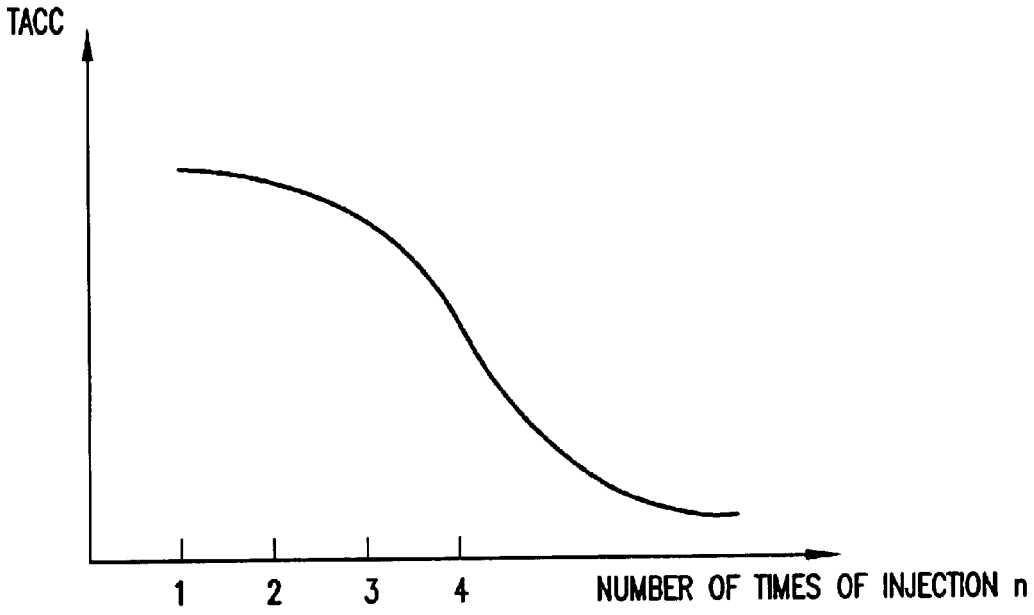
FIG. 11 is a graph showing relationship between a number of times of injection of fuel and a increase correction value.

When the flag F2 has been set, it is judged that the throttle valve 3 has been opened from a totally closed state, and the sequence will proceed to a step S23 to clear the flag F2. Subsequently, in a step S24, it is judged whether or not a number of times of injection of fuel n since a point in time whereat it is distinguished that the throttle valve 3 has been opened from the totally closed state is larger than a scheduled number of times, for example, eight times. When it has been distinguished that the number of times of injection of fuel n is equal to or less than the scheduled number of times, the number of times of injection of fuel n will be incremented (+1) in a step S25. In a step S26, an increase correction value TACC corresponding to the number of times of injection of fuel will be retrieved from correspondence relationship between such a number of times of injection of fuel n as shown in FIG. 11 and the increase correction value TACC. In a step S27, a flag F3 will be set to complete this subroutine.

Since the flag F3 has been set in a step S27, when this TACC retrieval routine is executed next, the judgment in the step S21 becomes affirmative, and the steps S22 and S23 will be skipped to proceed to a step S24. When it has been distinguished that the number of times of injection of fuel n is equal to or less than the scheduled number of times in a step S24, the processing in the above-described steps S25, S26 and S27 will be executed to complete this subroutine. When the throttle valve 3 has been opened from the totally closed state as described above, in the step S24, the above-described processing will be repeatedly executed until it is distinguished that the number of times of injection of fuel n is larger than a predetermined number of times.

On the other hand, when it has been distinguished in the step S24 that the number of times of injection of fuel n is larger than a scheduled number of times, the number of times of injection of fuel n will be initialized at "0" in a step S28. In a step S29, there will be calculated a difference ΔθTH between the throttle opening θTH (previous) detected previously and the throttle opening θTH (this time) detected this time. In a step S30, it is judged whether or not the difference ΔθTH in throttle opening exceeds a scheduled value, for example, 0.3 degree. When it is distinguished that the difference ΔθTH exceeds the scheduled value, in a step S31, an increase correction value TACC corresponding to the difference ΔθTH will be retrieved from a map of a correspondence relationship between the difference ΔθTH stored in ROM 31 and the increase correction value TACC, and in a step S32, the flag F3 will be cleared to complete this subroutine. On the other hand, when it has been distinguished in the step S30 that the difference ΔθTH is smaller than the scheduled value, the flag F3 will be cleared to complete this subroutine in the step S32.

Also, when the flag F2 has not been set in a step S105 of FIG. 9, that is, when it is distinguished that the throttle valve 3 has not been opened from the totally closed state, the flag F3 has been cleared. Therefore, the discrimination result in the step S21 becomes negative, and even in the step S22, the discrimination result becomes negative, and the sequence will proceed to the step S29. In the steps S29, S30 and S31, the previously described processing will be executed to complete this subroutine.

After this subroutine is completed, fuel injection time TOUT is calculated from, for example, TOUT=T0(Ne, PB) X KTA X KTW X KPA X K02+TACC . . . (formula 1), and injection quantity of fuel to be injected through a fuel injection valve 11 is controlled. In this case, T0(Ne, PB) is basic fuel injection time calculated from the number of revolutions Ne of the engine 1 and intake pipe negative pressure PB; KTA is a correction factor due to intake temperature TA; KTW is a correction factor due to cooling water temperature of the engine 1; KPA is a correction factor due to atmospheric pressure PA; and K02 is a correction factor due to oxygen concentration 02 to be contained in the exhaust gas.

FIG. 11 is a graph indicating the relationship between the number of times of injection of fuel n and the increase correction value TACC. The increase correction value TACC is set such that it is the largest when the number of times of injection n is "1" and becomes smaller as the number of times of injection n is increased. The relationship between the number of times of injection n and the increase correction value TACC is set as described above, whereby a good acceleration performance can be obtained when the throttle valve 3 is opened from the totally closed state for acceleration.

As will be apparent from the above-described description, according to the present invention, in controlling an engine having means for automatically opening and closing the throttle valve in accordance with the engine state like the fast idle operation, even when the throttle valve is automatically opened or closed, a totally closed value of the throttle valve is detected as a value obtained by eliminating the correction value to be added to the totally closed reference value. Therefore, there is no need for enlarging the dead zone of the totally closed value, but it is possible to make it into a narrow dead zone. As a result, when this narrow dead zone is exceeded, it can be detected that the throttle valve is opened and closed manually.

Also, according to the present invention, since the totally closed value is renewed when the narrow dead zone is exceeded, renewal can be performed by taking hold of a slight change in the totally closed value due to deterioration or the like. Therefore, the detection precision for the totally closed state can be improved. Particularly, according to the present invention, the totally closed state is not renewed by any instantaneous change. Also, according to the present invention, the precision of fuel increase correction is improved because the totally closed position is accurately detected.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine control device having manual opening and closing means and automatic opening and closing means of a throttle valve, in which a throttle opening indicated value for said automatic opening and closing means is a value obtained by adding, to a totally closed reference value, a water temperature correction value, that is a function of engine cooling water temperature, and an atmospheric pressure correction value, that is a function of the atmospheric pressure, comprising:

a throttle opening detection means for said engine control device for detecting the throttle opening, and a value obtained by subtracting said water temperature correction value and said atmospheric pressure correction value from an actual opening to be detected by said throttle opening detection means is set to a totally closed value of said throttle opening.

2. The engine control device according to claim 1, wherein a dead zone concerning said totally closed value is set and wherein when a value obtained by subtracting said water temperature correction value and said atmospheric pressure correction value from said actual opening goes out of said dead zone, there is provided renewal means for replacing said totally closed value with a value obtained by subtracting said water temperature correction value and said atmospheric pressure correction value from said actual opening.

3. The engine control device according to claim 2, wherein when the value obtained by subtracting said water temperature correction value and said atmospheric pressure correction value from said actual opening continues for a scheduled renewal time period to go out of said dead zone, said renewal means is constructed to renew the totally closed value.

4. The engine control device according to claim 3, wherein predetermined set fuel increase correction values are provided which are different from each other between when the opening is increased from said totally closed position and when the opening is increased from any other position than said totally closed position, and the structure is arranged so as to correct a reference amount of fuel supply by using said fuel increase correction value.

5. The engine control device according to claim 2, wherein predetermined set fuel increase correction values are provided which are different from each other between when the opening is increased from said totally closed position and when the opening is increased from any other position than said totally closed position, and the structure is arranged so as to correct a reference amount of fuel supply by using said fuel increase correction value.

6. The engine control device according to claim 1, wherein predetermined set fuel increase correction values are provided which are different from each other between when the opening is increased from said totally closed position and when the opening is increased from any other position than said totally closed position, and the structure is arranged so as to correct a reference amount of fuel supply by using said fuel increase correction value.

7. An engine control device comprising:

a throttle opening;

a manual opening and closing means for selectively opening and closing the throttle opening;

an automatic opening and closing means for selectively opening and closing the throttle valve;

a throttle opening indicated value for said automatic opening and closing means is a value obtained by adding, to a totally closed reference value, a water temperature correction value, that is a function of engine cooling water temperature, and an atmospheric pressure correction value, that is a function of the atmospheric pressure;

a throttle opening detection means for said engine control device for detecting the throttle opening, and a value obtained by subtracting said water temperature correction value and said atmospheric pressure correction value from an actual opening to be detected by said throttle opening detection means is set to a totally closed value of said throttle opening.

8. The engine control device according to claim 7, wherein a dead zone concerning said totally closed value is set and wherein when a value obtained by subtracting said water temperature correction value and said atmospheric pressure correction value from said actual opening goes out of said dead zone, there is provided renewal means for replacing said totally closed value with a value obtained by subtracting said water temperature correction value and said atmospheric pressure correction value from said actual opening.

9. The engine control device according to claim 8, wherein when the value obtained by subtracting said water temperature correction value and said atmospheric pressure correction value from said actual opening continues for a scheduled renewal time period to go out of said dead zone, said renewal means is constructed to renew the totally closed value.

10. The engine control device according to claim 9, wherein predetermined set fuel increase correction values are provided which are different from each other between when the opening is increased from said totally closed position and when the opening is increased from any other position than said totally closed position, and the structure is arranged so as to correct a reference amount of fuel supply by using said fuel increase correction value.

11. The engine control device according to claim 8, wherein predetermined set fuel increase correction values are provided which are different from each other between when the opening is increased from said totally closed position and when the opening is increased from any other position than said totally closed position, and the structure is arranged so as to correct a reference amount of fuel supply by using said fuel increase correction value.

12. The engine control device according to claim 7, wherein predetermined set fuel increase correction values are provided which are different from each other between when the opening is increased from said totally closed position and when the opening is increased from any other position than said totally closed position, and the structure is arranged so as to correct a reference amount of fuel supply by using said fuel increase correction value.

13. A method for controlling an engine having manual opening and closing means and automatic opening and closing means of a throttle valve, in which a throttle opening indicated value for said automatic opening and closing means is a value obtained by adding, to a totally closed reference value, a water temperature correction value, that is a function of engine cooling water temperature, and an atmospheric pressure correction value, that is a function of the atmospheric pressure, comprising the following steps:

detecting a throttle opening for said engine control device; and obtaining a value by subtracting said water temperature correction value and said atmospheric pressure correction value from an actual opening to be detected by detecting the throttle opening when the throttle opening is set to a totally closed value of said throttle opening.

14. The method for controlling an engine according to claim 13, including the step of setting a dead zone concerning said totally closed value and wherein when a value obtained by subtracting said water temperature correction value and said atmospheric pressure correction value from said actual opening goes out of said dead zone, there is provided renewal means for replacing said totally closed value with a value obtained by subtracting said water temperature correction value and said atmospheric pressure correction value from said actual opening.

15. The method for controlling an engine according to claim 14, wherein when the value obtained by subtracting said water temperature correction value and said atmospheric pressure correction value from said actual opening continues for a scheduled renewal time period to go out of said dead zone, said renewal means is constructed to renew the totally closed value.

16. The method for controlling an engine according to claim 15, wherein predetermined set fuel increase correction values are provided which are different from each other between when the opening is increased from said totally closed position and when the opening is increased from any other position than said totally closed position, and the structure is arranged so as to correct a reference amount of fuel supply by using said fuel increase correction value.

17. The method for controlling an engine according to claim 14, wherein predetermined set fuel increase correction values are provided which are different from each other between when the opening is increased from said totally closed position and when the opening is increased from any other position than said totally closed position, and the structure is arranged so as to correct a reference amount of fuel supply by using said fuel increase correction value.

18. The method for controlling an engine according to claim 13, wherein predetermined set fuel increase correction values are provided which are different from each other between when the opening is increased from said totally closed position and when the opening is increased from any other position than said totally closed position, and the structure is arranged so as to correct a reference amount of fuel supply by using said fuel increase correction value.

* * * * *